US006109966A

United States Patent [19]

Chiou

[11] Patent Number: 6,109,966

[45] Date of Patent: Aug. 29, 2000

[54] MINI DIN CONNECTOR HAVING A REDUCED HEIGHT ABOVE A CIRCUIT BOARD

[75] Inventor: Song-Rong Chiou, Taipei, Taiwan

[73] Assignee: Hon Hai Precision Ind. Co., Ltd., Taipei Hsien, Taiwan

[21] Appl. No.: 09/299,333

[22] Filed: Apr. 26, 1999

[30] Foreign Application Priority Data

Jul. 28, 1998 [TW] Taiwan ..... 87212144

[51] Int. Cl.[7] ..... H01R 13/648

[52] U.S. Cl. ..... 439/607

[58] Field of Search ..... 439/607, 609, 439/610

[56] References Cited

U.S. PATENT DOCUMENTS 5,564,948 10/1996 Harting et al. ..... 439/607
5,660,558 8/1997 Osanai et al. ..... 439/607
5,702,271 12/1997 Steinman ..... 439/607
5,941,725 8/1999 Brennan et al. ..... 439/607
5,975,955 11/1999 Bogiel et al. ..... 439/607

*Primary Examiner*—Lincoln Donovan
*Assistant Examiner*—Javaid Nasri
*Attorney, Agent, or Firm*—Wei Te Chung

[57] ABSTRACT

A mini DIN connector comprises an insulative housing, a number of terminals secured in the housing, a shield and a bottom cover. Side walls of the shield each include a cutout and an L-shaped boardlock extending from an upper edge of each cutout for securing the connector to a circuit board. The circuit board forms a cutout for receiving the connector. A support portion projects from each lateral face for engaging an edge of the cutout of the circuit board. When the boardlocks secure the connector to the circuit board, a bottom of the housing is located below the circuit board. Thus, the height of the connector above the circuit board is reduced. In addition, the bottom cover is mounted to the bottom of the housing thereby improving shielding against EMI.

9 Claims, 8 Drawing Sheets

MINI DIN CONNECTOR HAVING A REDUCED HEIGHT ABOVE A CIRCUIT BOARD

BACKGROUND OF THE INVENTION

1. Field of The Invention

The present invention relates to a mini DIN connector, and especially to a mini DIN connector having a reduced height above a circuit board and excellent shielding capabilities.

2. The Prior Art

Nowadays, personal computers, especially notebook computers, are becoming increasingly compact. The entire space within a PC enclosure must be efficiently used which becomes one of the most important design considerations for connectors mounted on a mother board. Related art is disclosed in U.S. Pat. Nos. 4,913,664; 4,946,400; 5,017,158; and 5,035,651.

Referring to FIG. 1, a conventional mini DIN connector 6 comprises an insulative housing 60, an external shield 61 and an internal shield 62. The external shield 61 forms a pair of boardlocks 610 adapted to secure the connector 6 to a mother board (not shown). However, the connector 6 does not promote a reduced height thereof above a circuit board and a bottom thereof is not shielded against external EMI (electromagnetic interference).

SUMMARY OF THE INVENTION

Accordingly, the primary object of the present invention is to provide a mini DIN connector having a reduced height above a circuit board.

Another object of the present invention is to provide a mini DIN connector having excellent shielding capabilities.

A further object of the present invention is to provide a mini DIN connector which can be firmly secured to a mother board.

To fulfill the above-mentioned objects, a mini DIN connector comprises an insulative housing, a plurality of terminals secured in the housing, a shield and a bottom cover. Side walls of the shield each include a cutout and an L-shaped boardlock outwardly extending from an upper edge of each cutout for securing the connector to a circuit board. The circuit board forms a cutout for receiving the connector. An elongate support portion projects from each lateral face of the housing for engaging a corresponding edge of the cutout of the circuit board. When the boardlocks secure the connector to the circuit board, a bottom of the housing is located below the circuit board. Thus, the height of the connector above the circuit board is reduced. In addition, the bottom cover is mounted to the bottom of the housing thereby improving shielding against EMI.

Other objects, advantages and novel features of the invention will become more apparent from the following detailed description when taken in conjunction with the accompanying drawings.

DETAILED DESCRIPTION OF A PREFERRED EMBODIMENT

Figure 1:
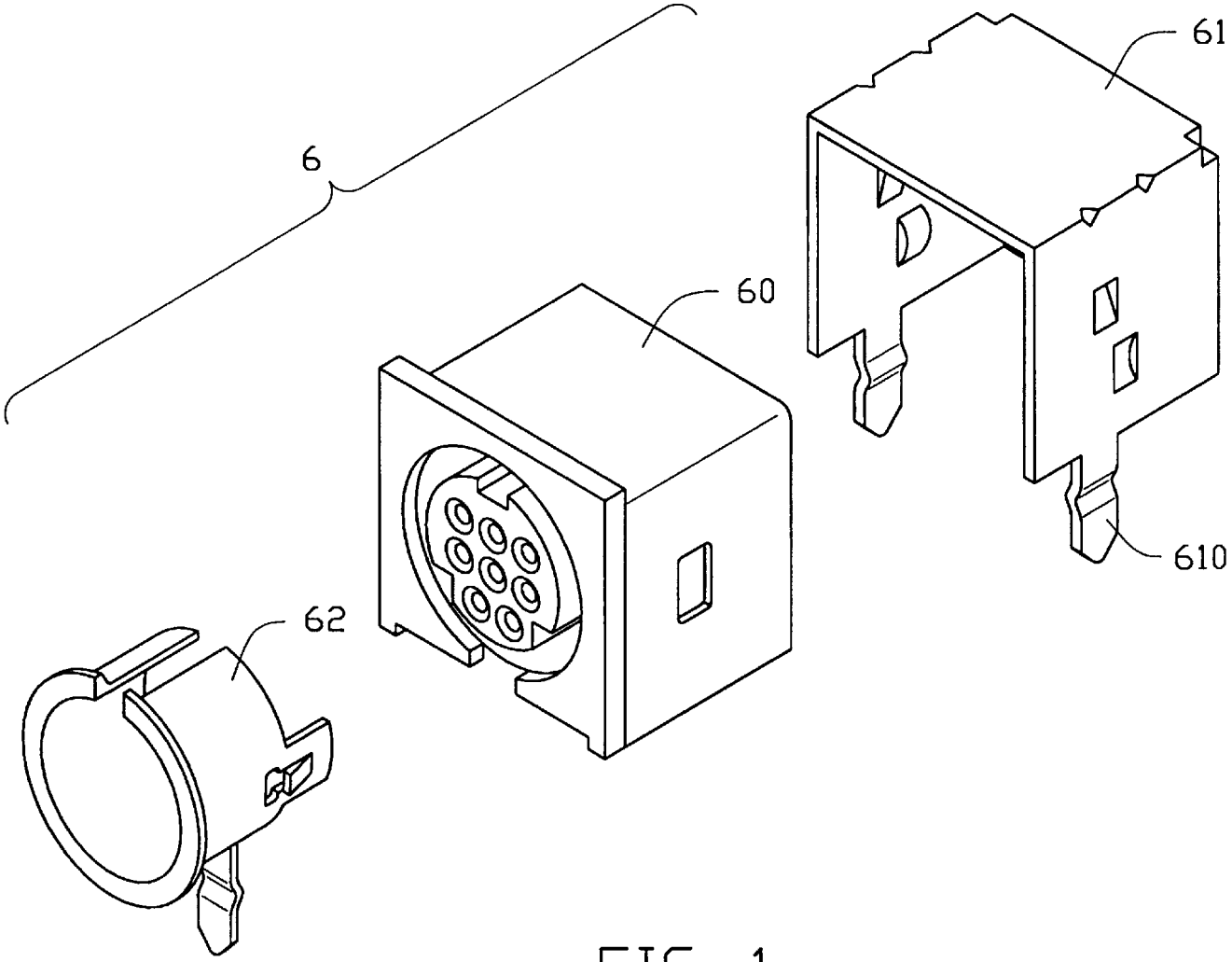
FIG. 1 (PRIOR ART)
FIG. 1 is an exploded view of a conventional mini DIN connector.

It is noted here that for facilitating understanding, like components are designated by like reference numerals throughout the various embodiments of the invention as shown in the attached drawing figures.

Figure 2:
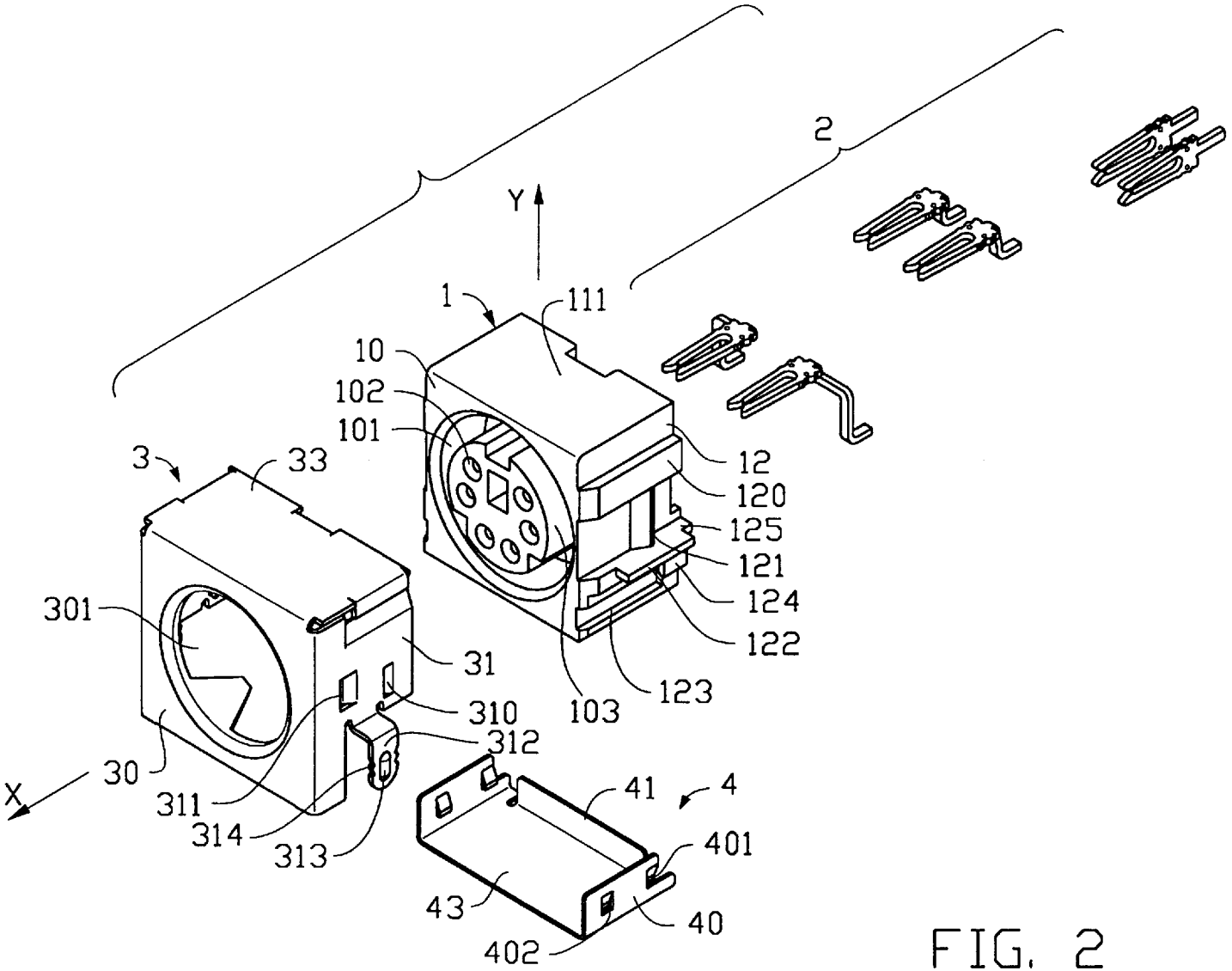
FIG. 2 is an exploded view of a mini DIN connector in accordance with the present invention.
Figure 3:
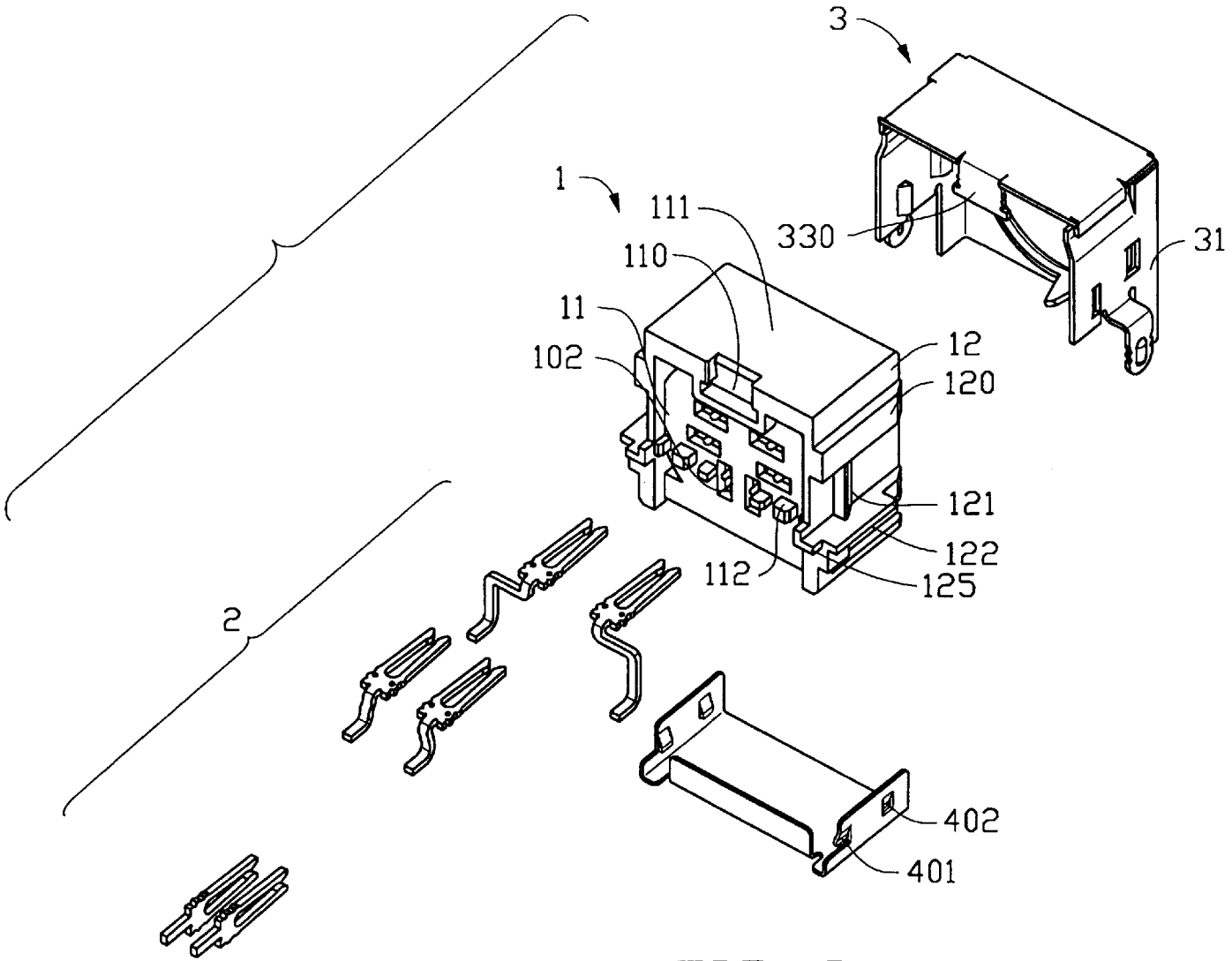
FIG. 3 is similar to FIG. 2 but viewed from a different perspective.

Referring to FIG. 2 and 3, a mini DIN connector comprises an insulative housing 1 with a plurality of terminal passageways 102, a plurality of terminals 2 retained in the passageways 102, a shield 3 and a bottom cover 4. The housing 1 has a mating face 10, a mounting face 11 opposite the mating face 10 and two lateral faces 12. An annular recess 101 is defined in the mating face 10 for receiving a shell member of a mating connector (not shown). A circular portion 103 extends into the recess 101 and a plurality of terminal passageways 102 are defined therethrough between the mating face 10 and the mounting face 11 for receiving the terminals 2. A T-shaped recess 110 is formed in the mounting face 11 proximate a top face 111 of the housing 1.

Further referring to FIG. 4, each lateral face 12 has an elongate projection 120 formed thereon and a support portion 122 parallel to and below the projection 120, both forming inclined edges proximate the mating face 10. A support end 125 rearwardly extends from the support portion 122 and projects from the mounting face 11. A vertical elongate ridge 121 is formed between the projection 120 and the support portion 122. An inclined edge is formed along a side of the ridge 121. A longitudinally extending groove 123 is defined below the support portion 122 and is exposed to the mating face at one end thereof. A stop block 124 is formed at an opposite end of the groove 123. In addition, a plurality of fixing portions 112 projects from the mounting face 11 proximate the passageways 102 for supporting the terminals 2.

The shield 3 is unitarily stamped and formed from a blank metal sheet and comprises a front wall 30, a pair of side walls 31 and a top planar portion 33. The side walls 31 and the top portion 33 are rearwardly bent from the front wall 30. The shield 3 is disposed around four sides of the housing 1. The front wall 30, the side walls 31 and the top portion 33 of the shield 3 engage with the front face 10, the lateral sides 12 and the top face 111 of the housing 1, respectively. The front wall 30 has a circular opening 301 defined therein for extension of the shell portion of the mating connector therethrough. Each side wall 31 forms a cutout (not labeled) in a bottom portion thereof and an L-shaped boardlock 312 outwardly extending from an upper edge of the cutout. A first resilient lance 310 and a second resilient lance 311 are inwardly stamped from the side wall 31. The L-shaped boardlock 312 has a horizontal section and a vertical section. An embossment 313 is formed on the vertical section and locking barbs 314 are formed on opposite edges of the vertical section.

Figure 6:
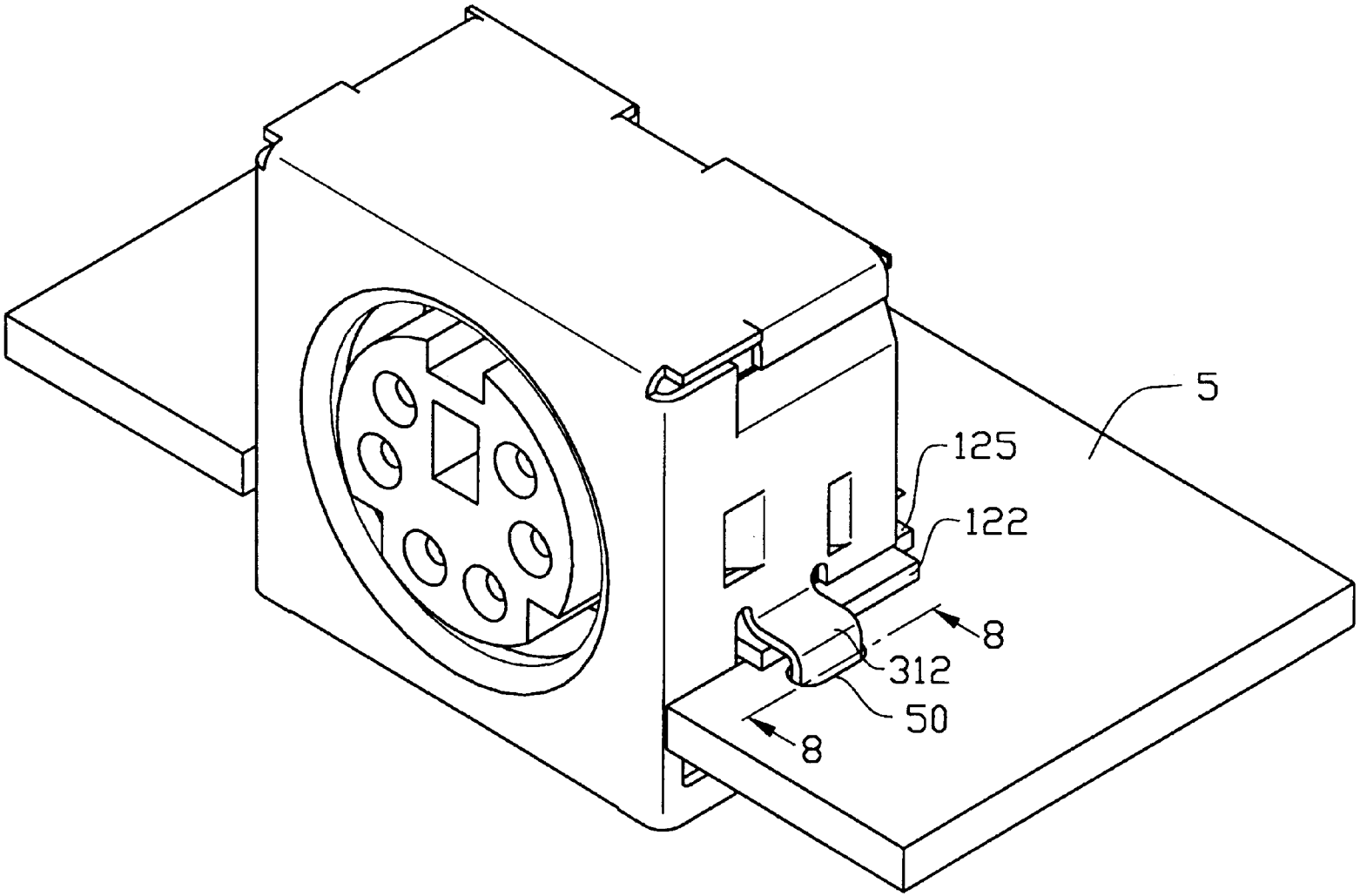
FIG. 6 is an assembled view of FIG. 5 wherein the mini DIN connector is secured to a circuit board.

In assembly, the first lance 310 engages with the ridge 121 for preventing the shield 3 from moving in the direction of arrow "X". The second lance 311 abuts against a lower side of the projection 120 for preventing the shield 3 from moving in the direction of arrow "Y". When the shield 3 fully covers the corresponding faces of the housing 1, the horizontal portion of the L-shaped boardlock 312 rests on the support portion 122 (FIG. 6). The top portion 33 of the shield 3 has a T-shaped lock 330 adapted to be secured in the recess 110. Thus, the shield 3 is firmly attached to the housing 1.

Figure 4:
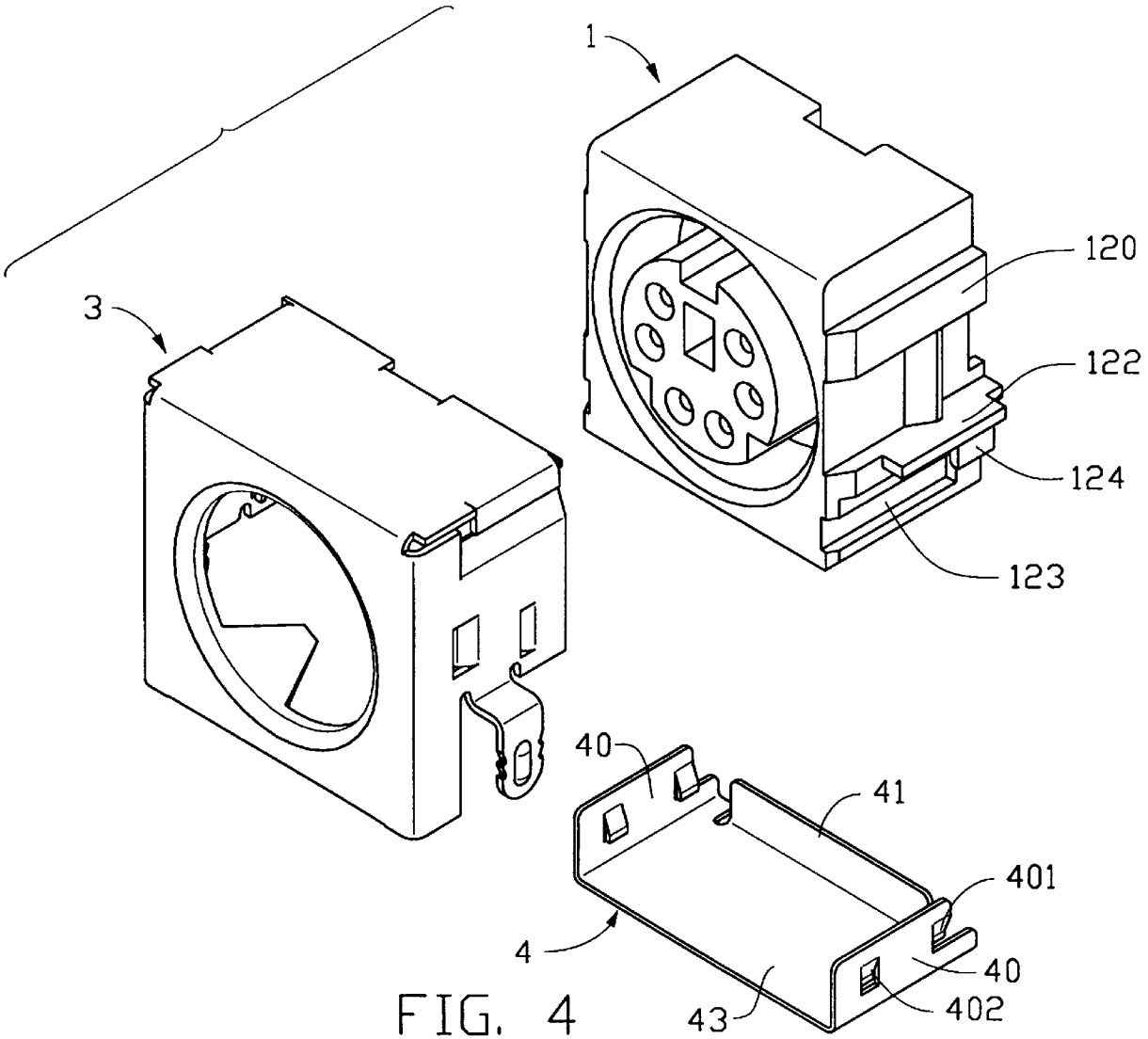
FIG. 4 is a magnified view of FIG. 2 omitting terminals.

Referring to FIG. 4, the bottom cover 4 has a flat base 43, a pair of lateral walls 40 upwardly extending from opposite lateral edges of the base 43 and a rear wall 41 upwardly extending from a rear edge of the base 43. Each lateral wall 40 forms a pair of inwardly projecting lances 401, 402 for being receiving in the groove 123 of the housing thereby securing the bottom cover 4 to a bottom of the shield 3 and providing shielding to a bottom of the housing 1. The stop portion 124 of the housing 1 prevents the bottom cover 4 from moving rearward.

Figure 5:
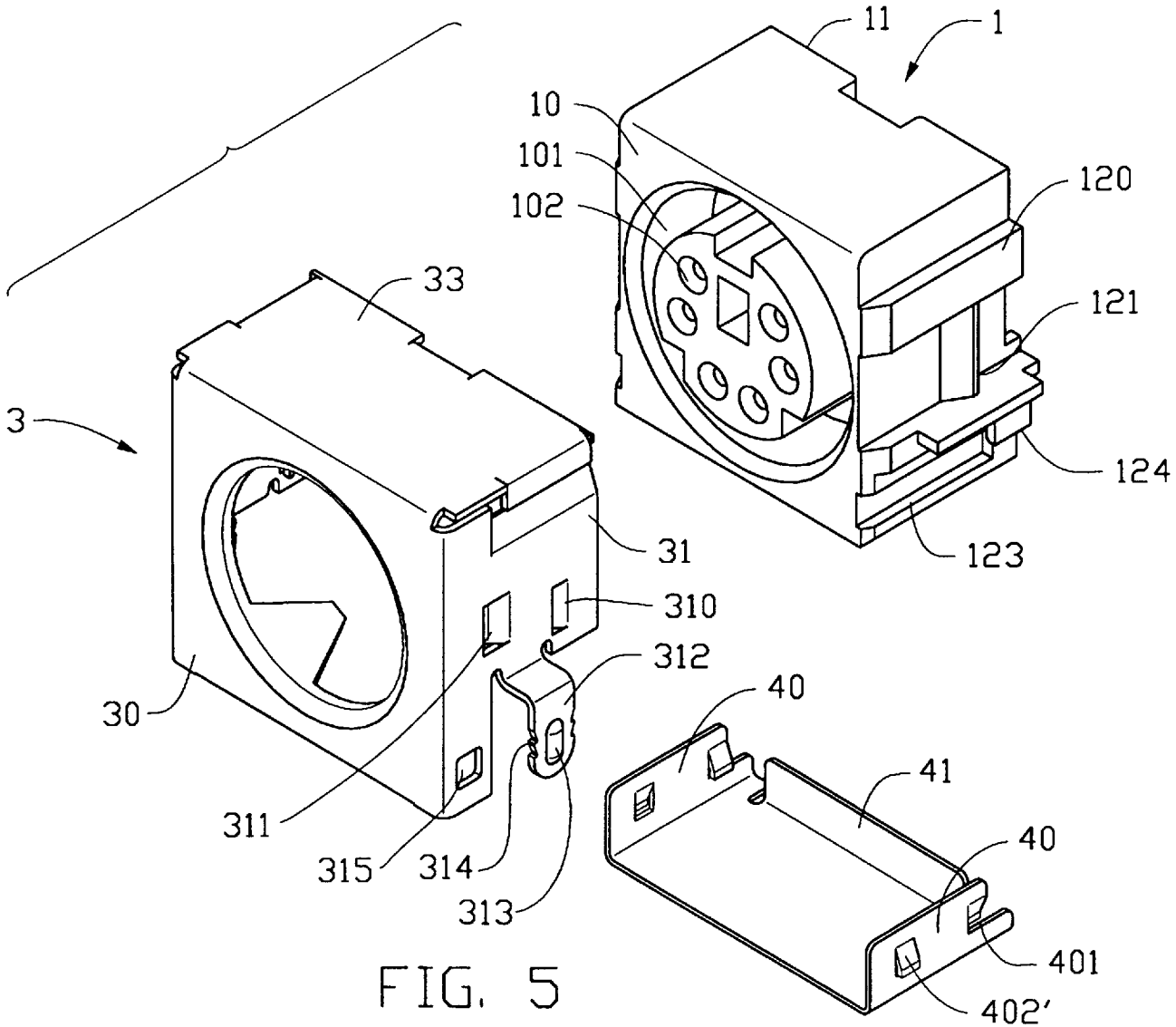
FIG. 5 is an exploded view of a second embodiment of the present invention.

Referring to FIG. 5, in another embodiment of the present invention, the bottom cover 4 forms a pair of outwardly extending lances 402' in the opposite lateral walls 40 thereof for engaging corresponding windows 315 formed in the side walls 31 of the shield 3.

Figure 7:
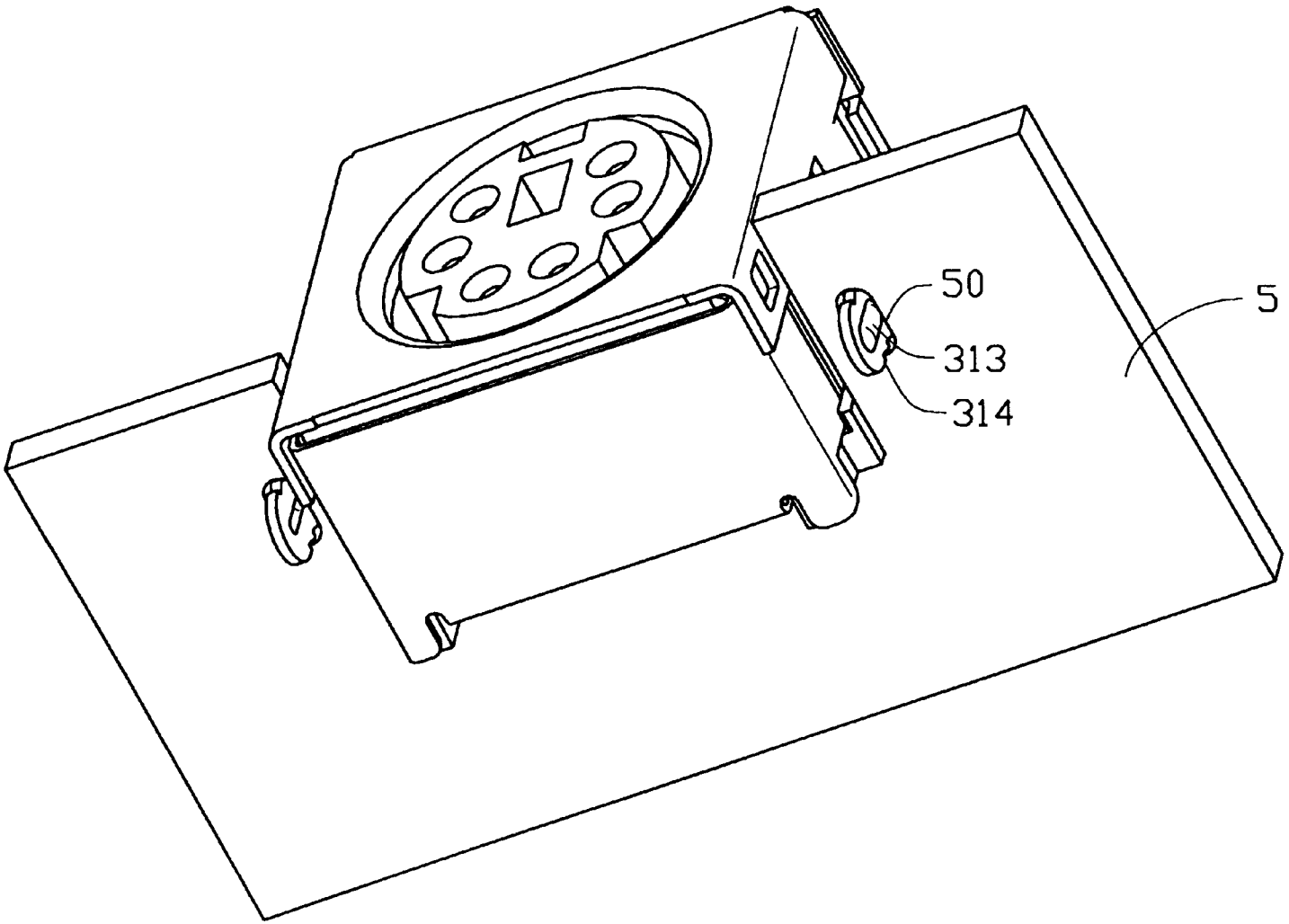
FIG. 7 is a perspective view different from that shown in FIG. 6.
Figure 8:
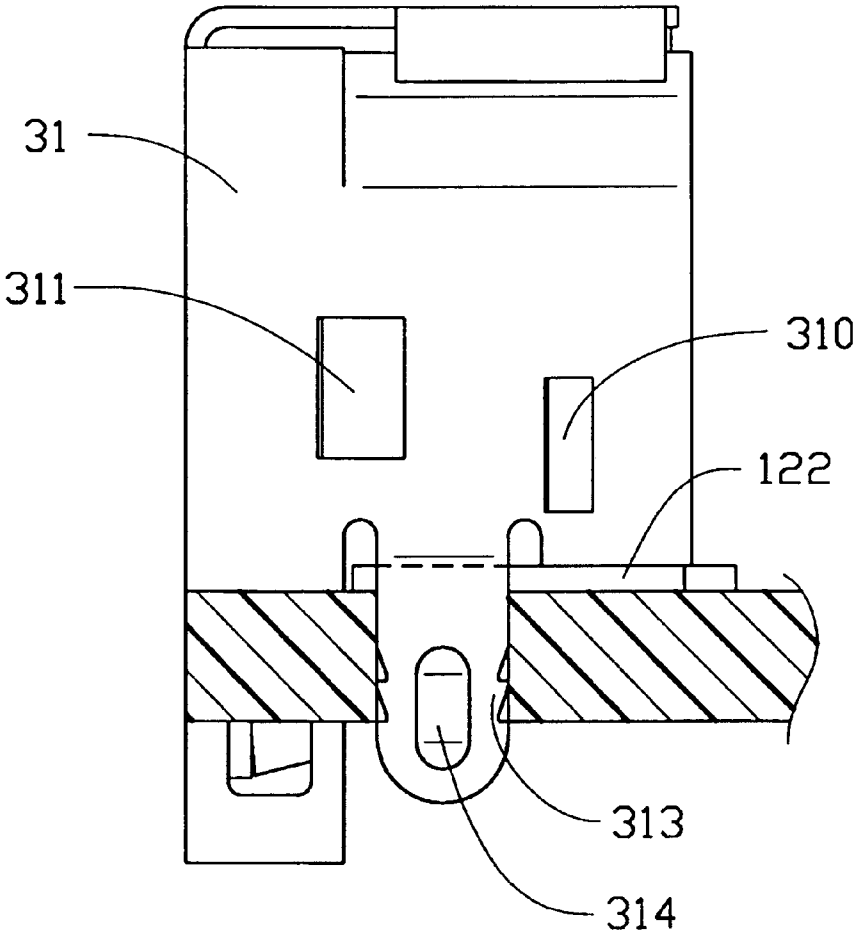
FIG. 8 is a cross-sectional view taken along line 8—8 of FIG. 6.

Referring to FIGS. 6 and 7, a circuit board 5 for supporting the mini DIN connector forms a rectangular cutout in an edge thereof and the mini DIN connector is snuggly fit into the cutout. The support portions 122 and the support ends 125 of the housing 1 engage three edges of the cutout for retaining the connector. The L-shaped boardlocks 312 of the shield 3 are interferentially fit in corresponding holes 50 of the circuit board 5 (FIG. 8) thereby securing the connector to the circuit board 5. Thus, a lower portion of the connector is located below the circuit board 5 which reduces the height of the connector above the circuit board.

It can be appreciated that because the circuit board 5 forms a rectangular cutout which allows the bottom portion of the housing 1 to receivably extend therethrough for lowering the profile of the mini DIN, thus resulting in exposure of the bottom portion of the housing 1. The invention provides a bottom cover 4 which includes not only the base 43 but also the pair of lateral walls 40 for fully shielding such originally exposed portion, and cooperating with the shield 3 for efficiently preventing penetration of EMI through any of lateral directions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being received in a cutout formed in a circuit board, comprising:

an insulative housing having a mating face, a mounting face opposite the mating face, a pair of lateral faces, a bottom face between and below the mating, mounting and lateral faces, and a plurality of terminal passageways defined between the mating face and the mounting face, the insulative housing having a support portion projecting from each lateral face of the housing for engaging an edge of the cutout formed in the circuit board;

a plurality of terminals received in the passageways; and a shield partially covering outer surfaces of the housing, the shield having a pair of cutouts out of which the support portions of the housing extend, and a pair of boardlocks extending from upper edges of the cutouts of the shield, each boardlock having a horizontal portion and a vertical portion extending downward to a position above the bottom face of the housing.

2. The electrical connector as claimed in claim 1, wherein an embossment is formed on the vertical section of the boardlock and locking barbs are formed along opposite edges of the vertical section.

3. The electrical connector as claimed in claim 1 further comprising a bottom cover attached to the bottom face of the housing.

4. The electrical connector as claimed in claim 3, wherein the bottom cover has a pair of lateral walls upwardly extending from opposite lateral edges thereof.

5. The electrical connector as claimed in claim 4, wherein each lateral wall of the bottom cover forms at least one inwardly projecting lance engaged with the housing, thereby securing the bottom cover to the bottom of the housing.

6. The electrical connector as claimed in claim 4, wherein the bottom cover has at least one lance outwardly extending from opposite lateral walls thereof for engaging the shield.

7. The electrical connector as claimed in claim 1, wherein a support end rearwardly extends from each support portion and projects from the mounting face for engaging a edge of the cutout of the circuit board.

8. An electrical assembly comprising:

an electrical connector including an insulative housing defining at least a mating face, a top face and two lateral faces and a plurality of terminals received within said housing, the insulative housing having a support portion projecting laterally from each lateral face thereof;

a circuit board defining a cutout through which a bottom portion of the housing projects with a distance so as to form a low profile of said connector with regard to the circuit board, and an edge of the cutout engaging each support portion of the housing a shield attached to the housing and defining a top portion and two side walls covering said top face and said lateral faces, respectively, the two side walls of the shield forming a pair of cutouts out of which the support portions of the housing extend, and a pair of boardlocks extending from upper edges of the cutouts, each boardlock comprising a horizontal portion and a vertical portion interferentially fitting a hole defined in the circuit board; and a bottom cover defining at least a flat base covering the bottom portion of the housing.

9. The assembly as claimed in claim 8, wherein the bottom cover further includes a pair of lateral walls engaging with the side walls of the shield for fully shielding the corresponding lateral faces.

* * * * *